US010746509B2

(12) United States Patent
Deering

(10) Patent No.: US 10,746,509 B2
(45) Date of Patent: Aug. 18, 2020

(54) LIGHTWEIGHT ANTI-BALLISTIC DOOR AND ANTI-BALLISTIC PANEL

(71) Applicant: R2P Innovations, LLC, Goose Creek, SC (US)

(72) Inventor: Anthony Deering, Daniel Island, SC (US)

(73) Assignee: R2P Innovations, LLC, Goose Creek, SC (US)

( * ) Notice: Subject to any disclaimer, the term of this patent is extended or adjusted under 35 U.S.C. 154(b) by 0 days.

(21) Appl. No.: 16/121,025

(22) Filed: Sep. 4, 2018

(65) Prior Publication Data

US 2020/0072580 A1 Mar. 5, 2020

(51) Int. Cl.

| | |
|---|---|
| ***F41H 5/04*** | (2006.01) |
| ***F41H 5/24*** | (2006.01) |
| ***E06B 5/12*** | (2006.01) |
| *F41H 5/26* | (2006.01) |

(52) U.S. Cl.

CPC ..... *F41H 5/0457* (2013.01); *E06B 5/12* (2013.01); *F41H 5/0407* (2013.01); *F41H 5/24* (2013.01); *F41H 5/263* (2013.01)

(58) Field of Classification Search

CPC ..... F41H 5/24; F41H 5/0407; F41H 5/226; F41H 5/263; C04B 41/009

USPC ..... 89/36.01–36.07; 428/911; 109/49.5

See application file for complete search history.

(56) References Cited

U.S. PATENT DOCUMENTS 3,529,389 A * 9/1970 Wilkins ..... E04B 1/6125 174/497
4,186,648 A * 2/1980 Clausen ..... B32B 5/28 89/36.02
4,604,249 A 8/1986 Luhleich et al.
5,058,815 A * 10/1991 Pozzato ..... B02C 13/1835 241/191
5,164,536 A * 11/1992 Barbaza ..... A47C 5/00 244/122 R
6,327,954 B1 12/2001 Medlin
6,713,008 B1 * 3/2004 Teeter ..... B29C 70/025 264/240
6,726,876 B1 4/2004 Staker (Continued)

FOREIGN PATENT DOCUMENTS

| | | |
|---|---|---|
| WO | 2007044063 A2 | 4/2007 |
| WO | 2014183597 A1 | 11/2014 |
| WO | 2016154014 A1 | 9/2016 |

OTHER PUBLICATIONS

"Ballistic Charts: UL 752 and NIJ IV", Nationwide Structures, Inc. (online), Aug. 25, 2018, https://web.archive.org/web/20180829000144/http://www.nationwidestructures.com/ballistic-key.html/.

*Primary Examiner* — Michael D David

(57) ABSTRACT

An anti-ballistic door having a keyed joint assembly substantially defining an inner perimeter of the door, and a bullet persistent panel secured internal to the door using the keyed joint assembly. The anti-ballistic door has up to a UL 752-Level 8 protection rating having a lower weight relative to conventional anti-ballistic doors and is sized to fit within conventionally sized door frames. An anti-ballistic panel is additionally provided having a keyed joint assembly substantially defining an inner perimeter of the panel, and a bullet persistent panel secured internal to the panel using the keyed joint assembly. The anti-ballistic panel has up to a UL 752-Level 8 protection rating.

19 Claims, 5 Drawing Sheets

(56) References Cited

U.S. PATENT DOCUMENTS

| | | | | |
|---|---|---|---|---|
| 7,926,406 | B2 | 4/2011 | Warren et al. | |
| 9,200,480 | B2 | 12/2015 | Deiler | |
| 9,766,045 | B2 | 9/2017 | Fultz | |
| 9,850,654 | B2 | 12/2017 | Shalev | |
| 9,941,030 | B2 | 4/2018 | Williamson | |
| 9,976,306 | B1 | 5/2018 | Homer | |
| 10,001,228 | B2 | 6/2018 | Gundstrup | |
| 10,060,181 | B1 | 8/2018 | Jones, Jr. et al. | |
| 2001/0031350 | A1* | 10/2001 | Day | B29C 70/086 428/317.9 |
| 2002/0124497 | A1 | 9/2002 | Fortin et al. | |
| 2006/0266207 | A1 | 11/2006 | Cerny | |
| 2009/0031887 | A1* | 2/2009 | Monteil | F41F 3/073 89/1.8 |
| 2011/0185468 | A1* | 8/2011 | Olesnicky | A41D 13/0531 2/44 |
| 2011/0252956 | A1 | 10/2011 | Sawtell et al. | |
| 2015/0292841 | A1 | 10/2015 | Fultz | |
| 2016/0010953 | A1* | 1/2016 | Baron, Sr. | F41H 5/013 89/36.02 |
| 2017/0299347 | A1 | 10/2017 | Fultz | |
| 2018/0087315 | A1 | 3/2018 | Glover | |
| 2020/0072580 | A1 | 3/2020 | Deering | |

* cited by examiner

LIGHTWEIGHT ANTI-BALLISTIC DOOR AND ANTI-BALLISTIC PANEL

FIELD OF INVENTION

The present invention provides an anti-ballistic door and an anti-ballistic panel for rejecting the penetration of high velocity bullets or other projectiles fired at such a door or a panel. The present invention further provides an anti-ballistic metal used in forming a core panel for use in the anti-ballistic door and the anti-ballistic panel of the invention. The present invention also provides a method of manufacturing such an anti-ballistic door and anti-ballistic panel.

BACKGROUND

A security door is intended to provide a bullet resistant door that is used to protect the occupants in a safe room from external threats. Such a door is intended to provide a bullet resistant entry door for the room. In recent years, there have been incidents involving loss of life when an individual or individuals armed with guns have entered buildings such as malls and other commercial buildings, government offices, hospitals, and schools and universities, killing people in those locations, including those intending to take refuge in different rooms. Additionally, the owners of residences in certain unsafe areas or owners that are at greater risk of facing armed individuals in their residence, such as prosecutors, government officials, and individuals in the public eye, have installed so-called "safe rooms" at an increasing frequency. As a result, there is an increasing need for bullet resistant security doors that can be used to create secure rooms in places such as malls and other commercial buildings, government offices, hospitals, and schools and universities and to act as the entry door for safe rooms in residences.

Conventional bullet resistant doors are often heavy and inappropriately sized to fit within conventional door frames, and they require special door frames to hold the doors. Additionally, the weight and size of the conventional bullet resistant doors make the doors more difficult to open and close. Since special door frames are required, many times it is often more difficult and expensive to retrofit a building with bullet resistant security doors to replace pre-existing non-bullet resistant doors. Additionally, due to the heavier construction of the door, current bullet resistant doors are often expensive and more difficult to manufacture. The heavier weight of the conventional bullet resistant doors also impacts hardware wear and tear, product lifestyle, and cost of ownership. The conventional anti-ballistic door total weight also impacts freight and shipment costs of raw components as well as the finished door shipment cost.

While some lighter-weight doors have been produced, using a bullet resistant fiberglass in conjunction with layers of structural composite lumber, such prior art doors have been unable to pass certain desirable certifications, most notably certifications from UL for protection levels. That is, these prior art doors are unable to pass the protection level certification tests of UL, namely the Level 8 Protection Level tests of the UL 752 standard, which is the level of protection that provides resistance to penetration by military assault rifle bullets, such as the M-14, and other similar projectile objects. Comparatively, Level 7 Protection under the UL 752 standard ensures protection against bullets fired from an ArmaLite AR-15 rifle.

There is a long-felt need for a security door that is bullet resistant, yet is lighter weight, is easy to manufacture, and that can be easily retrofitted onto existing doorframes that provides the desired level of protection for projectiles and ammunition fired into the door.

In addition to the protection of rooms in residences, commercial and educational spaces, there is an accelerating demand for lighter weight anti-ballistic panels that provide protection for certain areas having importance. One such type of area is where military equipment and personnel are positioned. However, the demand for such lighter weight protective panels is growing due to the interest in protecting other areas of importance. These other areas include, for example, security personnel structures, power plants and electrical substations, manufacturing facilities including petroleum refineries and petroleum and chemical storage facilities, . . . .

There remains in need in the art for anti-ballistic panels that are lighter weight that may be used in barriers constructed to prevent the penetration of bullets and other projectiles into intended protected areas.

SUMMARY OF INVENTION

The present invention relates to an anti-ballistic door and an anti-ballistic panel for rejecting the penetration of high velocity bullets or other projectiles fired at such a door or a panel. Without intending to be bound by theory, the anti-ballistic door and anti-ballistic panel of the invention offers improved protection, but at reduced overall weight in comparison to conventional anti-ballistic doors and panels. An inventive anti-ballistic metal used in forming a core panel for use in the anti-ballistic door and the anti-ballistic panel of the invention is additionally provided.

An aspect of the invention provides an anti-ballistic door comprising a keyed joint assembly substantially defining an inner perimeter of the door; and a bullet persistent panel secured internal to the door using the keyed joint assembly. According to an embodiment of the invention, the anti-ballistic door has at least a UL 752-Level 6 protection rating.

In an embodiment of the invention, the anti-ballistic door additionally comprises foam layers substantially covering both sides of the bullet persistent panel. Further pursuant to this embodiment of the invention, the foam layers may be adhesively bonded to the bullet persistent panel.

Optionally, the anti-ballistic door of the invention may comprise a lite. Further pursuant to this embodiment of the invention, the anti-ballistic door comprises an aperture where an anti-ballistic glass is inserted to define the lite.

In certain embodiments of the invention, the anti-ballistic door also comprises a leading stile, the leading stile comprising a laminated stile, and a leading stile halve, and the laminated stile and the leading stile halve defining the key joint assembly along the leading stile. In certain embodiments of the invention, the laminated stile comprises a backing and a hardwood edge. Further pursuant to this embodiment of the invention, the laminated stile may additionally include an intumescent strip between the backing and the hardwood edge to provide a fire rated door. In still certain other embodiments of the invention, the backing comprises a structural composite lumber backing.

According to an embodiment of the invention, the keyed joint assembly includes a key along shaft and key walls, and the bullet persistent panel is inserted in the key along shaft. In certain embodiments of the invention, a clearance layer is provided to accommodate at least one of an adhesive and variations in a shape of the bullet persistent panel.

According to certain embodiments of the invention, the panel has a crossband veneer layer. In other embodiments of the invention, the anti-ballistic door has a UL 752-Level 8 protection rating.

In another aspect of the invention, the invention provides an anti-ballistic panel comprising a keyed joint assembly substantially defining an inner perimeter of the panel; and a bullet persistent panel secured internal to the panel using the keyed joint assembly. According to an embodiment of the invention, the anti-ballistic panel at least has a UL 752-Level 6 protection. In certain embodiments of the invention, the anti-ballistic panel additionally includes foam layers substantially covering both sides of the bullet persistent panel.

In an embodiment of the invention, the keyed joint assembly may comprise a key along shaft defined by the key walls, and the bullet persistent panel inserted in the key along shaft additionally having a clearance layer to accommodate at least one of an adhesive and any variations in a shape of the bullet persistent panel. In certain embodiments of the invention, the anti-ballistic panel has a UL 752-Level 8 protection rating.

In yet another aspect, the invention provides a method for manufacturing an anti-ballistic panel comprising the steps of providing a bullet persistent panel; substantially covering both sides of the bullet persistent panel with a foam layer; including a leading stile and a hanging stile, each having a laminated stile and a stile halve defining a key joint assembly for securing the bullet persistent panel; additionally including a top rail and a bottom rail, each having a key along shaft and key walls defining the key joint assembly for securing the bullet persistent panel; securing the top rail and the bottom rail to the leading stile and the hanging stile by inserting key inserts of each of the top rail and the bottom rail into the key joint assembly of the leading stile and the hanging stile; and finishing the anti-ballistic door with a panel. In certain embodiments of the invention, the anti-ballistic door manufactured according to such a method of manufacturing an anti-ballistic panel has at least a UL 752-Level 6 protection, or, more preferably, a UL 752-Level 8 protection.

The method of manufacturing the anti-ballistic door additionally may comprise providing a foam layer that is adhesively bonded to the bullet persistent panel. Optionally, the method of manufacturing an anti-ballistic door may include the step of inserting an anti-ballistic glass in an aperture of the anti-ballistic door to define a lite.

In certain embodiments of the invention, the anti-ballistic door manufactured according to this method of manufacture may comprise a laminated stile comprising a backing and a hardwood edge. Further pursuant to this embodiment of the invention, the laminated stile may additionally comprise an intumescent strip between the backing and the hardwood edge to provide a fire rated ant-ballistic door.

In this method of manufacturing an anti-ballistic door, the key along shaft may additionally comprise a clearance layer that accommodates at least one of an adhesive and variations in a shape of the bullet persistent panel.

Other aspects and embodiments will become apparent upon review of the following description taken in conjunction with the accompanying drawings. The invention, though, is pointed out with particularity by the included claims.

BRIEF DESCRIPTION OF THE DRAWINGS

Figure 1:
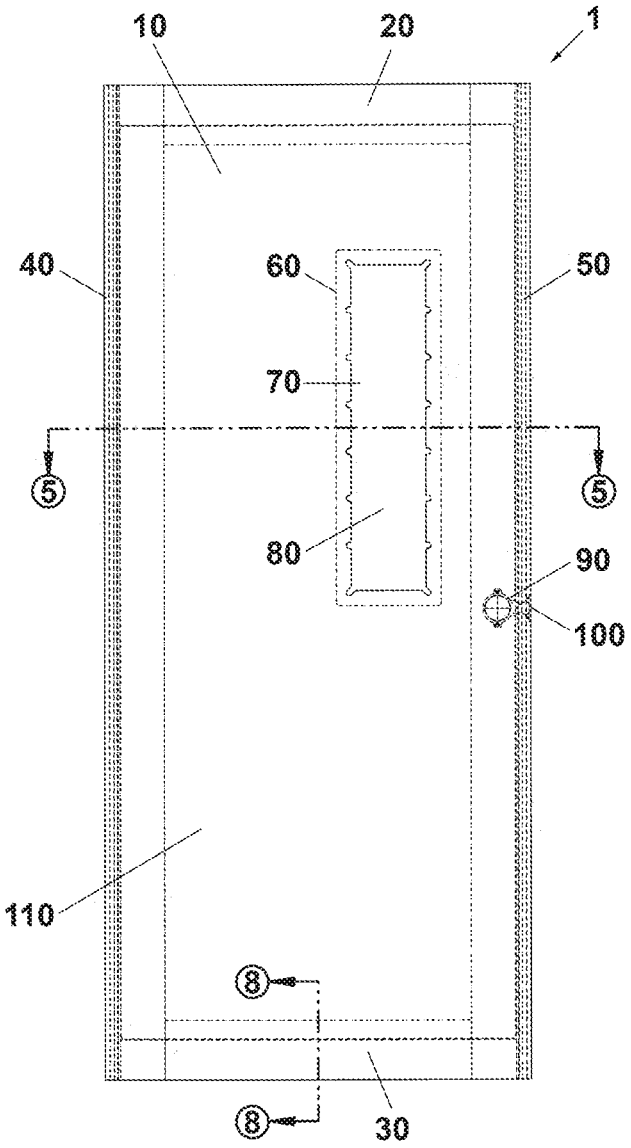
Figure 2:
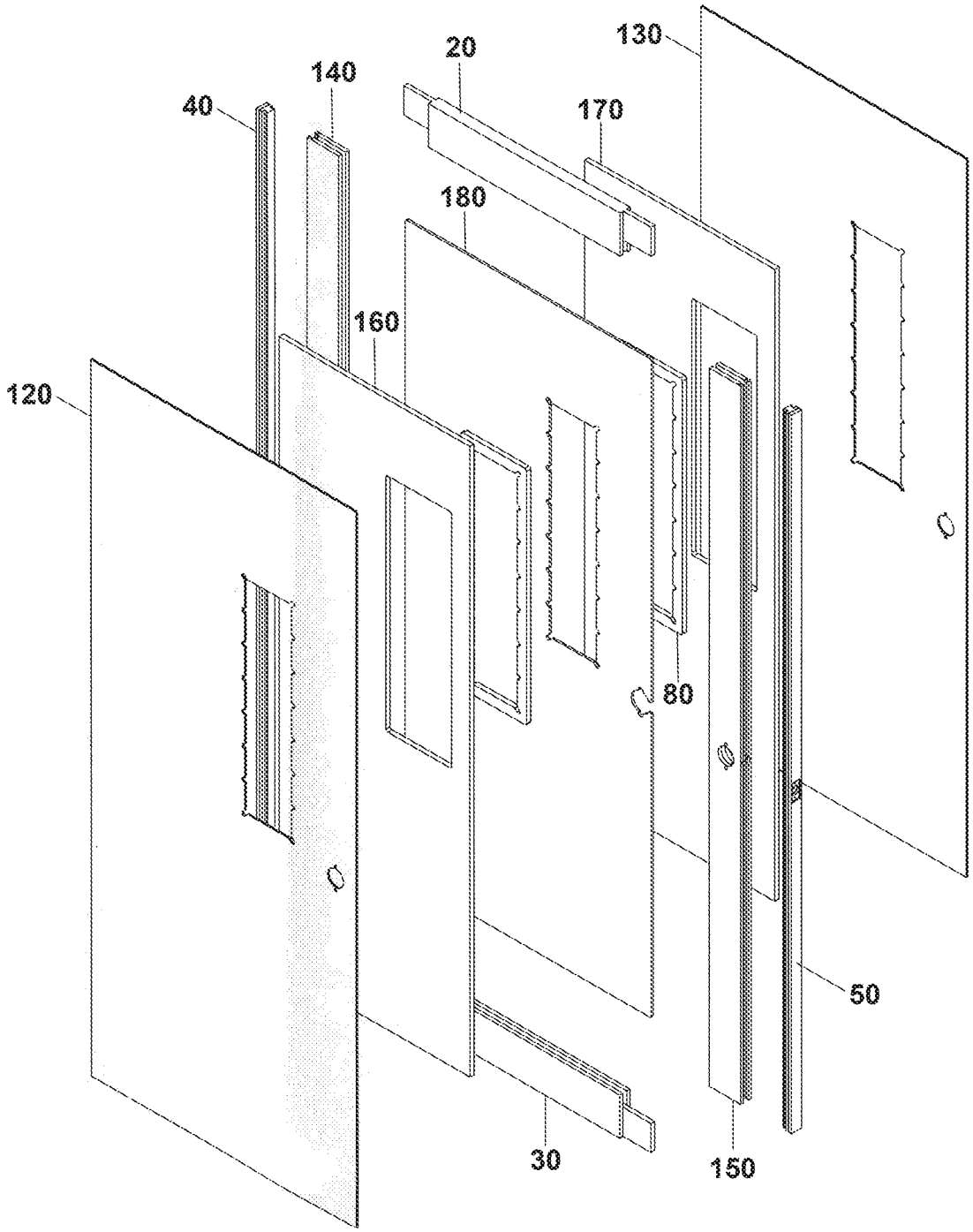
Figure 3:
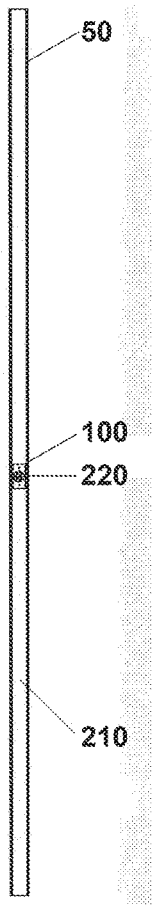
Figure 4:
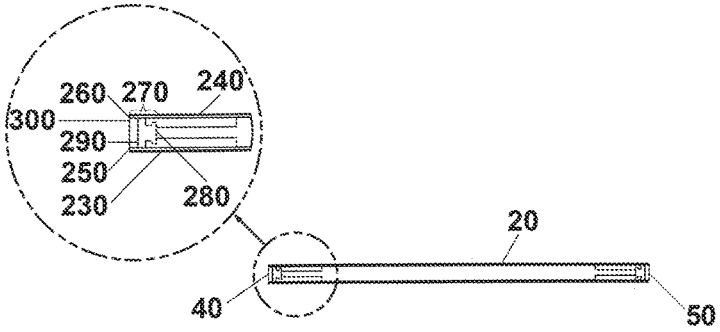
Figure 5:
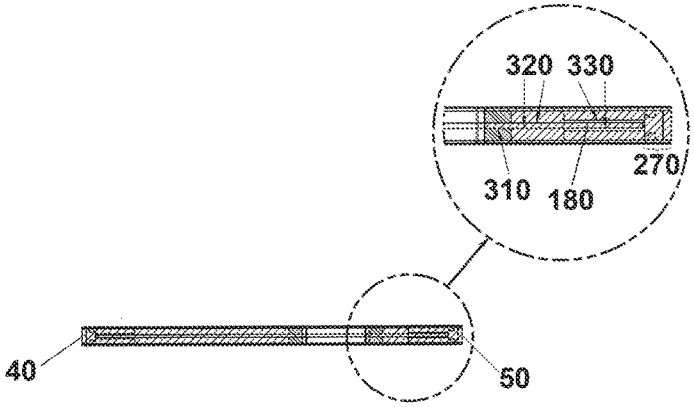
Figure 6:
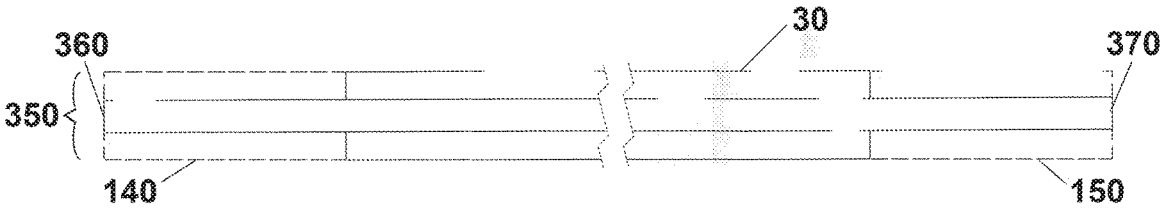
Figure 7:
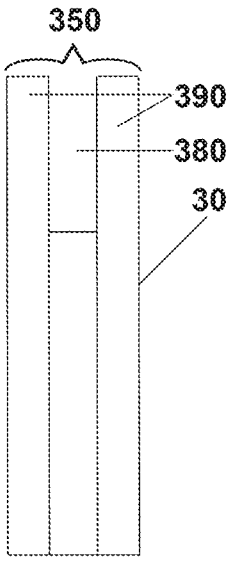
Figure 8:
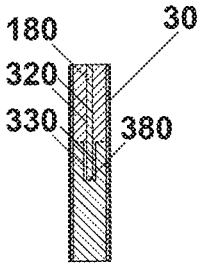
Figure 9:
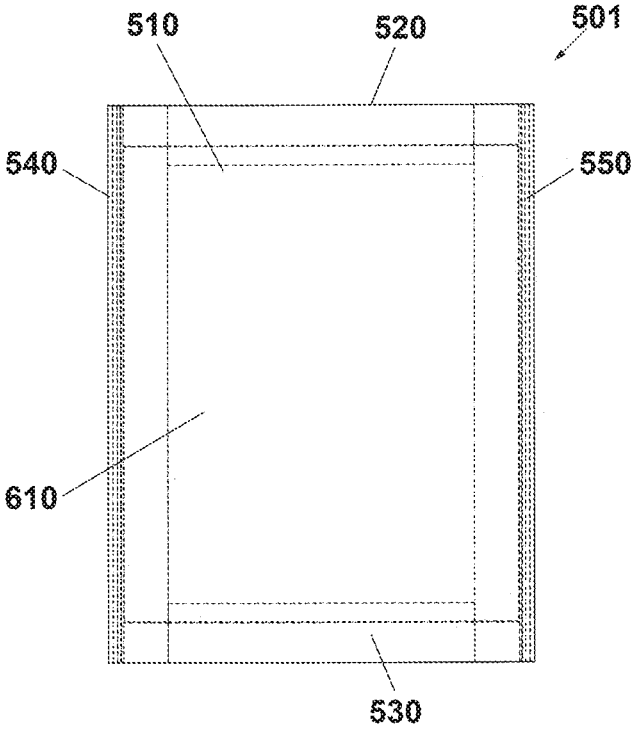
Figure 10:
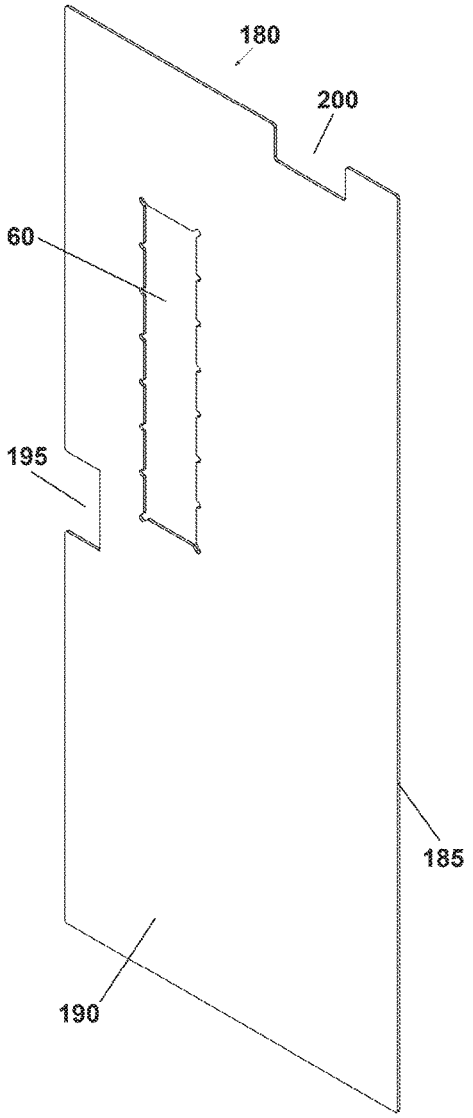
Figure 11:
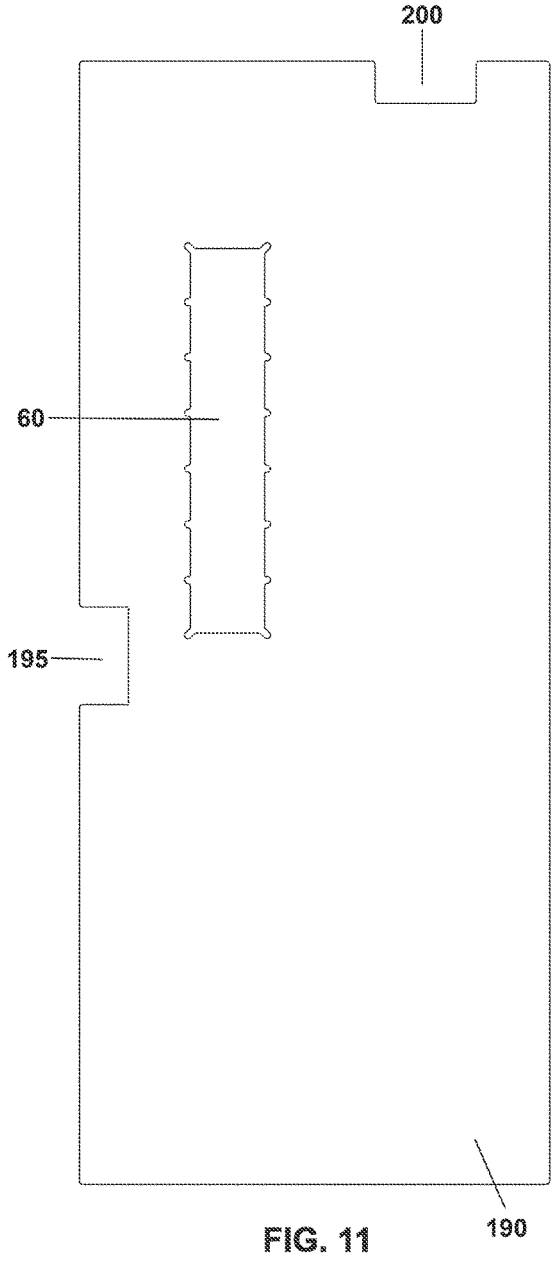
Figure 12:
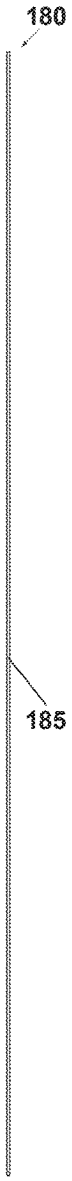

Having thus described the invention in general terms, reference will now be made to the accompanying drawings, which are not necessarily drawn to scale, and wherein:

FIG. 1 is a plane view of a panel of the anti-ballistic door, according to an embodiment of the invention;

FIG. 2 is a perspective view of the assembly of an anti-ballistic door, according to an embodiment of the invention;

FIG. 3 is a side view of an anti-ballistic door showing a plane view of a leading stile, according to an embodiment of the invention;

FIG. 4 is a top view of an anti-ballistic door showing a plane view of a top rail, according to another embodiment of the invention;

FIG. 5 is a cross-sectional view taken along line 5-5 in FIG. 1 showing a middle rail of the anti-ballistic door, according to certain embodiments of the invention;

FIG. 6 is a bottom view of an anti-ballistic door showing a plane view of a bottom rail, according to another embodiment of the invention;

FIG. 7 is a plane side view of a bottom rail of an anti-ballistic door, according to an embodiment of the invention;

FIG. 8 is a cross-sectional view taken along line 8-8 of FIG. 1 showing a middle plane view of a bottom rail, according to an embodiment of the invention;

FIG. 9 is a plane view of an anti-ballistic panel, according to another embodiment of the invention;

FIG. 10 is a three-dimensional view of a bullet persistent panel according to an embodiment of the invention;

FIG. 11 is a front view of the bullet persistent panel according to an embodiment of the invention; and FIG. 12 is a side view of the bullet persistent panel according to an embodiment of the invention.

DETAILED DESCRIPTION OF THE INVENTION

The present invention now will be described more fully hereinafter with reference to the accompanying drawings, in which some, but not all embodiments of the inventions are shown. Preferred embodiments of the invention may be described, but this invention may, however, be embodied in many different forms and should not be construed as limited to the embodiments set forth herein. Rather, these embodiments are provided so that this disclosure will be thorough and complete, and will fully convey the scope of the invention to those skilled in the art. The embodiments of the invention are not to be interpreted in any way as limiting the invention.

As used in the specification and in the appended claims, the singular forms "a", "an", and "the" include plural referents unless the context clearly indicates otherwise. For example, reference to "an anti-ballistic metal" may include a plurality of such anti-ballistic metals.

It will be understood that relative terms may be used herein to describe one element's relationship to another element as, for example, may be illustrated in the Figures. It will be understood that relative terms are intended to encompass different orientations of the elements in addition to the orientation of elements as illustrated in the Figures. It will be understood that such terms can be used to describe the relative positions of the element or elements of the invention and are not intended, unless the context clearly indicates otherwise, to be limiting.

Embodiments of the present invention are described herein with reference to various perspectives, including, for example, perspective views that are representations of idealized embodiments of the present invention. As a person having ordinary skill in the art would appreciate, variations from or modifications to the shapes as illustrated in the Figures or the described perspectives are to be expected in practicing the invention. Such variations and/or modifications can be the result of manufacturing techniques, design considerations, and the like, and such variations are intended to be included herein within the scope of the present invention and as further set forth in the claims that follow. The articles of the present invention and their respective components described or illustrated in the Figures are not intended to reflect a precise description or shape of the component of an article and are not intended to limit the scope of the present invention.

Although specific terms are employed herein, they are used in a generic and a descriptive sense only and not for purposes of limitation. All terms, including technical and scientific terms, as used herein, have the same meaning as commonly understood by one of ordinary skill in the art to which this invention belongs unless a term has been otherwise defined. It will be further understood that terms, such as those defined in commonly used dictionaries, should be interpreted as having a meaning as commonly understood by a person having ordinary skill in the art to which this invention belongs. It will be further understood that terms, such as those defined in commonly used dictionaries, should be interpreted as having a meaning that is consistent with their meaning in the context of the relevant art and the present disclosure. Such commonly used terms will not be interpreted in an idealized or overly formal sense unless the disclosure herein expressly so defines otherwise.

As used herein, an "anti-ballistic door" and an "anti-ballistic panel" refers to a door and a panel, respectively, that meets or exceeds certain United Laboratories (UL) 752 Specifications and Ammunition, 11th Edition, Standard for Bullet Resisting Equipment. In one embodiment of the invention, the anti-ballistic door and anti-ballistic panel meets or exceeds UL 752-Level 6, which provides, in a non-limiting example, protection against multiple shots fired from a submachine-gun, such as a 9 mm Uzi and the like, having a muzzle energy of 540-653 foot-pounds (732-885J). In another embodiment of the invention, the anti-ballistic door and anti-ballistic panel meets or exceeds UL 752-Level 7, which provides, in a non-limiting example, protection against multiple shots fired from a M16/AR-15 military assault rifle firing a 5.56 mm full metal copper jacket cartridge having a lead core (.223 caliber). In a preferred embodiment of the invention, the anti-ballistic door and anti-ballistic panel meets or exceeds UL 752-Level 7, which provides, in a non-limiting example, protection against multiple shots fired from a M14 military assault rifle firing a 7.62 mm full metal copper jacket ball having a lead core (.308 caliber).

An aspect of the invention provides an anti-ballistic door capable of withstanding projectiles at least having a UL 752-Level 6 rating. The design of the anti-ballistic door of the invention is such that it is relatively lightweight, especially in comparison to conventional anti-ballistic doors, and the anti-ballistic door of the invention is sized such that it may fit into a standard sized doorframe preventing the need for any retrofitting when using the anti-ballistic door of the invention to replace an existing door in a conventional frame.

The inventors have conceived of novel and unique design for a door and a panel allowing such door and panel to function as an anti-ballistic door and an anti-ballistic panel. The inventive design allows the anti-ballistic door and the anti-ballistic panel to meet or exceed UL 752-Level 6, UL 752-Level 7 or, preferably, UL 752-Level 8 standards. The anti-ballistic door and the anti-ballistic panel of the invention includes a frame design that allows a bullet persistent panel to be supported in and form a core of the anti-ballistic door and the anti-ballistic panel.

Preferably, the anti-ballistic door and the anti-ballistic panel of the invention are lighter in weight than conventional anti-ballistic doors and anti-ballistic panels, and the anti-ballistic door and the anti-ballistic panel of the invention are sized to easily fit within standard doorways and/or enclosures preventing the need for any extensive retrofit of existing structures where such an anti-ballistic door or anti-ballistic panel is being installed. In other preferred embodiments of the invention, the anti-ballistic door and the anti-ballistic panel is non-ricocheting in nature where any attacking projectile is captured and retained by the anti-ballistic door and the anti-ballistic panel. Without intending to be bound by the theory, non-ricocheting anti-ballistic doors and anti-ballistic panels reduce the potential of a random injury from a ricocheting projectile or prevent lateral penetration of the projectile within the anti-ballistic door and anti-ballistic panel.

FIG. 1 is a plane view of a panel of the anti-ballistic door, according to an embodiment of the invention. As shown in FIG. 1, an anti-ballistic door 1 comprises a panel 10. According to the embodiment of the invention represented by FIG. 1, the sides of the anti-ballistic door 1 surrounding the panel 10 are provided by an interconnected arrangement including a top rail 20, a bottom rail 30, a hanging stile 40 and a leading stile 50. As further discussed herein, the top rail 20 and the bottom rail 30 include a keyed joint that allows the bullet persistent panel 180 (discussed in further detail in FIG. 2) to be secured vertically within an inner core 110 of the exemplary anti-ballistic door 1 of FIG. 1.

The hanging stile 40 is typically configured to include hardware to allow the anti-ballistic door 1 to be hung. The leading stile 50 may include hardware that allows the anti-ballistic door 1 to remain closed in the door frame and perhaps even to be locked when closed.

As shown in the exemplary embodiment of FIG. 1, the anti-ballistic door 1 may comprise a lite 70 including an anti-ballistic glass 80 and a window aperture 60 through the anti-ballistic door 1 through which the anti-ballistic glass 80 is placed. The anti-ballistic glass 80 is configured to match the window aperture 60 cutout. The exemplary embodiment of FIG. 1 includes a face bore 90, which is a large diameter hole included in the anti-ballistic door 1 through which a doorknob may be placed. Additionally, an edge bore 100 may be included for a lock assembly.

An anti-ballistic door typically includes the inner core 110 as shown in FIG. 1 for this exemplary embodiment of the anti-ballistic door 1 of the invention. Inner cores of conventional anti-ballistic doors include a solid core layer of wood and wood core layers having a plastic laminate and honeycomb structured layers made of woven fibered or polymeric that may be additionally laminated each having lower levels of protection; solid metallic, such as steel, doors having higher levels of protection but an extremely heavy weight; fiberglass core layers such as a fiberglass panels are made of multiple layers of woven roving ballistic grade fiberglass cloth impregnated with a thermoset polyester resin and compressed into flat rigid sheets that tend to be limited on the number of projectiles that may be stopped; as well as others that suffer from similar limitations. However, the inner core 110 design of the anti-ballistic door 1 of the invention is what offers unique advantages such as a preferred weight and size as balanced against a higher level and virtually unlimited number of projectiles that may be stopped.

FIG. 2 is a perspective view of the assembly of an anti-ballistic door, according to an embodiment of the invention. Another aspect of the invention provides a method for manufacturing an antiballistic door. FIG. 2 both illustrates a structure of an anti-ballistic door, according to one embodiment of the invention, and shows the steps based upon the addition of various different components how such an anti-ballistic door may be manufactured.

The outer layers of the anti-ballistic door 1 of the exemplary embodiment of the invention of FIG. 2 includes a crossband veneer 120 and a diametrically opposed crossband veneer 130 on the opposite side of the door. The crossband veneer 120, 130, which may be replaced by other types of layers in certain embodiments of the invention, includes a second layer of veneer under a top layer of veneer with the grains of the two layers of veneer running opposite to each other. Such a configuration reinforces the top layer of veneer.

The sides of the anti-ballistic door 1 each additionally comprises a hanging stile halve 140 adjacent to the hanging stile 40 and a leading stile halve 150 adjacent to the leading stile 50. As further discussed herein, the handing stile halve 140 in combination with the hanging stile 40 and the leading stile halve 150 in combination with the leading stile 50 form the keyed joint that allows the bullet persistent panel 180 to be secured horizontally within the inner core 110 of the anti-ballistic door 1. In the exemplary embodiment of FIG. 2, the bullet persistent panel 180 is configured to have a foam layer 160 and a diametrically opposed foam layer 170 on the opposite side of the bullet persistent panel 180. Without intending to be bound by theory, the foam layers 160, 170 accommodate for any variations in the flat surface that may exist in the bullet persistent panel 180.

Material that may be used for the bullet persistent panel 180 includes, but is not limited to, an anti-ballistic metal that may be included in an anti-ballistic layer configuration. In certain embodiments of the invention, the metal of the bullet persistent panel 180 may comprise steel, aluminum, copper and any combination thereof.

In an embodiment of the invention, the bullet persistent panel 180 may include a porous body of silicon carbide having open and through-penetrating pores that is prepared from a deformable mass of particles of silicon and carbon coated with an organic binder (SiC body). The pores of the body are filled with steel and/or a steel alloy under pressure of at least 1 bar followed by cooling. According to this embodiment of the invention, the silicon/steel composite is formed into the bullet persistent panel 180 of the anti-ballistic door 1. In an embodiment of the invention, the porosity of the SiC body is from about 30% to about 70% and from about 40% to about 50% according to another embodiment of the invention. In certain embodiments of the invention, the pore size is up to about 500 μm. In other embodiments of the invention, the pore size ranges, on average, from about 5 μm to about 30 μm.

In another embodiment of the invention, the bullet persistent panel 180 is formed from or includes an alloy of uranium. In certain embodies of the invention, the alloy of uranium comprises a ternary alloy of uranium comprising from about 0.01 wt % to about 0.95 wt % niobium, from about 1.0 wt % to about 4.5 wt % vanadium and the remainder is uranium with some smaller content, perhaps not more than 1000 weight parts per million of carbon as an impurity.

In yet another embodiment of the invention, the metal of the bullet persistent panel 180 comprises a manganese steel including from about 9 wt % to about 30 wt % manganese (Mn) and from about 1 wt % to about 4 wt % aluminum (Al). The manganese steel may optionally comprise any or any combination of up to about 6 wt % of silicon (Si), up to about 4 wt % copper (Cu), up to about 4% nickel (Ni) and up to about 1 wt % carbon (C). The remainder of the manganese steel comprises iron as well as impurities.

In certain other embodiments of the invention, the bullet persistent panel 180 comprises a multilayer panel having a front-face anti-ballistic layer, a backing armor layer and the two layers joined via metallurgical bonding that includes a metallic based intermediate layer. Further pursuant to this embodiment of the invention, the layers are joined by using wide-area welding techniques, using technology of explosive cladding (high-velocity impact cladding), by roll welding or by a combination of these techniques.

In an embodiment of the invention, the front-face anti-ballistic layer is a steel alloy containing 0.66 wt % of carbon, 0.40 wt % of silicone, 0.40 wt % of manganese, no more than about 0.010 wt % of phosphorus, no more than about 0.010 wt % of sulfur, 1.20 wt % of chromium, 0.20 wt % of nickel, 0.20 wt % of vanadium, 1.90 wt % of tungsten, while the remainder is iron and other accompanying elements and impurities. In certain other embodiments of the invention, the backing armor layer is a steel alloy comprising 0.30 wt % of carbon, 1.60 wt % of silicone, 1.40 wt % of manganese, no more than about 0.010 wt % of phosphorus, no more than about 0.008 wt % of sulfur, 0.40 wt % of chromium, 1.20 wt % of nickel, the remainder is iron and other accompanying elements and impurities.

In certain embodiments of the invention, the metallic based intermediate layer is a face-centered cubic crystalline lattice comprising 71.0 wt % of nickel, 16.0 wt % of chromium, 3.0 wt % of manganese, 1.0 wt % of molybdenum, 2.0 wt % of niobium, 6.0 wt % of iron and perhaps other accompanying elements as well as impurities commonly encountered in these types of alloys.

In yet other embodiments of the invention, the bullet persistent panel 180 comprises two or more layers comprising an aluminum alloy that are metallurgically bonded and then wrought. The aluminum alloy compositions may include, in non-limiting examples, alloys of the AA series 1000, 2000, 3000, 4000, 5000, 6000, 7000, or 8000. In certain embodiments of the invention, the selected aluminum alloy includes from about 2 wt % to about 6 wt % of magnesium.

FIG. 3 is a side view of an anti-ballistic door showing a plane view of a leading stile, according to an embodiment of the invention. The leading stile 50 illustrated in FIG. 3 includes a lipping 210, which defines an exposed facing of the leading stile 50. However, the lipping 210 may alternatively have a laminate, such as a PVC laminate, or a veneer facing that extends over the lipping 210. The leading stile 50 illustrated in FIG. 3 also shows an active lock 220 that has been seated within the edge boor 100 included in the anti-ballistic door 1.

FIG. 4 is a top view of an anti-ballistic door showing a plane view of a top rail, according to another embodiment of the invention. The top rail 20 shown in FIG. 4 includes an enlarged call-out that shows a detailed view of a side of the hanging stile 40 and hanging stile halves 140 that collectively form the keyed joint that allows the bullet persistent panel 180 to be secured horizontally within the inner core 110 of the anti-ballistic door 1. A veneer layer is included at both sides 230, 240 of the door, each layer of which is reinforced using a crossband veneer layer 250, 260. Of course, the door may include any other layered construction other than that comprising veneer, however, it is preferred that any such other layered construction be reinforced in some way, such as through appropriate selection of the material, the design, construction, and/or connection to the door itself.

Also shown in FIG. 4 is a laminated stile 270 defining the hanging stile 40 as called out here and also included, as illustrated, in the leading stile 50 as well. The laminated stile 270 includes a backing 280. In certain embodiments of the invention, the backing 280 comprises a structural composite lumber (SCL) backing. An intumescent strip 290 may optionally align with the backing 280, in particular, any backing 280 that could be subjected to a flame, in the event the anti-ballistic door is to be made fire rated. The laminated stile 270 additionally includes an edge 300. In certain embodiments of the invention, the edge 300 comprises a hardwood edge.

A thickness of the laminated stile 270, according to certain embodiments of the invention, may be from about 1.25 cm (0.5 in.) to about 12.5 cm (4.9 in.), from about 2.5 cm (1 in.) to about 6.5 cm (2.6 in.), from about 2.5 cm (1 in.) to about 5.0 cm (2 in.), or from about 2.5 cm (1 in.) to about 3.5 cm (1.4 in.). A thickness of the backing 280, according to certain embodiments of the invention, 1 cm (0.4 in.) to about 10 cm (3.9 in.), from about 1.25 cm (0.5 in.) to about 5 cm (2 in.), from about 1.5 cm (0.6 in.) to about 2.5 cm (1 in.), or from about 2 cm (0.8 in.) to about 2.3 cm (0.9 in.). A thickness of the intumescent strip 290, according to certain embodiments of the invention, may be from about 0.25 cm (0.1 in.) to about 2.5 cm (1 in.), from about 0.4 cm (0.15 in.) to about 2 cm (0.8 in.), or from about 0.5 cm (0.2 in.) to about 1 cm (0.4 in.). Of course, any configuration known in the art having the benefit of this disclosure may be used to provide fire resistance to the anti-ballistic door or anti-ballistic panel.

The design of the laminated stile 270 may have configurations that differ from the exemplary embodiment of FIG. 4. The laminated stile need not have a shaped design, but may include any design configuration that could be embodied within top rail and/or bottom rail of the invention.

FIG. 5 is a cross-sectional view taken along line 5-5 in FIG. 1 showing a middle rail of the anti-ballistic door, according to certain embodiments of the invention. FIG. 5 is included to show one possible configuration for an anti-ballistic door 1 that includes a lite 70. An enlarged call-out shown in FIG. 5 provides a detailed view of how the bullet persistent panel 180 may be designed to fit in place with an assembly for the lite 70. A window block 310 secures the ant-ballistic glass 80 about the window aperture 60 provided in the bullet persistent panel 180 for the lite 70. The bullet persistent panel 180 configured with its foam about both sides or, optionally, a secured foam core 320 may be used to secure the window block 180 about and the bullet persistent panel 180 within the keyed joint that secures the bullet persistent panel 180 within the anti-ballistic door 1. FIG. 5 additional shows a clearance layer 330 that is included about both sides of the bullet persistent panel 180 inserted into the key joint. The clearance layer 330 may include an adhesive to secure the bullet persistent panel 180 to the keyed joint and to accommodate variations in the shape of the bullet persistent panel 180.

FIG. 6 is a bottom view of an anti-ballistic door showing a plane view of a bottom rail, according to another embodiment of the invention. In this exemplary embodiment of the invention, the illustrated bottom rail 30, as well as the top rail 20, which is not shown in this illustration but is similar in concept, is designed to include a keyed joint 350 that vertically secures the bullet persistent panel 180 to the upper and low portions of the anti-ballistic door 1. The bottom rail 30 includes a key insert for the hanging rail halve 360 that secures the bottom rail 30 into the hanging rail halves 140, and a key insert for the leading rail halve 370 that secures the bottom rail 30 into the leading rail halves 150.

FIG. 7 is a plane side view of a bottom rail of an anti-ballistic door, according to an embodiment of the invention. This side view of the bottom rail 30 illustrated in FIG. 7 shows the keyed joint 350 includes a key along shaft 380 where the bullet persistent panel 180 is inserted. The key along shaft 380 of the keyed joint 350 is defined by the key walls 390.

FIG. 8 is a cross-sectional view taken along line 8-8 of FIG. 1 showing a middle plane view of a bottom rail, according to an embodiment of the invention. FIG. 8 illustrates the bullet persistent panel 180 inserted into the keyed joint 350 of the bottom rail 30. The bullet persistent panel 180 is surrounded by its foam core 320 on both sides of the bullet persistent panel 180, and the clearance layer 330 exists at both sides where the bullet persistent panel 180 is inserted into the keyed joint 350.

In still another aspect, the invention provides an anti-ballistic panel capable of withstanding projectiles at least having a UL 752-Level 6 rating. The design of the anti-ballistic panel of the invention is such that it is relatively lightweight, especially in comparison to conventional anti-ballistic panels.

FIG. 9 is a plane view of an anti-ballistic panel, according to another embodiment of the invention. An exemplary embodiment of an anti-ballistic panel 501 shown in FIG. 9 includes a panel 510 surrounded by a top segment 520, a bottom segment 530, a left segment 540 and a right segment 550. The panel 510, the top segment 520, the bottom segment 530, the left segment 540 and the right segment 550 encompass the inner core segment 610 where a bullet persistent panel as further defined herein is included.

The anti-ballistic doors may come in different sizes, colors, patterns, finishes and varying models supporting, in particular, an intended use of the anti-ballistic door. For example, as further described herein, the anti-ballistic door may include any of the elements commonly found in doors including, without limitation, bevel, caming, casing, composite panels, fiberglass core layer(s), joinery, keying, handing, sill, door swing, weather strip and the like.

FIG. 10 is a three-dimensional view of a bullet persistent panel according to an embodiment of the invention. A bullet persistent panel 180, otherwise know as a door armor, is shaped to include the window aperture 60. The bullet persistent panel 180 of FIG. 10 includes a strike face 190. The exemplary bullet persistent panel 180 of FIG. 10 is shaped to also include a bore aperture 195 to accommodate the bores for the handle and, optionally, a lock, and a bore closure aperture 200 to accommodate a closing apparatus on doors configured to have such mechanisms. FIG. 11 is a front view of the bullet persistent panel according to an embodiment of the invention; and FIG. 12 is a side view of the bullet persistent panel according to an embodiment of the invention showing door armor side 185 of the bullet persistent panel 180. A thickness of the bullet persistent panel 180 as measured by the width of the door armor side 185 illustrated in FIG. 12 is sized to allow the anti-ballistic door or anti-ballistic panel to meet the desired protection level to be achieved according to the UL 752 standard. The types of material and fabrication of the bullet persistent panel 180 determines how thick the bullet persistent panel 180 must be to ensure it meets the desired UL 752 standard.

In an embodiment of the invention, the material and fabrication of the bullet persistent panel 180 is such that the thickness of the bullet persistent panel 180 is from about 5.0 mm (0.2 in.) to about 10 mm (0.4 in.), from about 5.0 mm (0.2 in) to about 7.5 mm (0.3 in.), from about 5.0 mm (0.2 in.) to about 6 mm (0.254 in.), from about 5.0 mm (0.2 in.) to about 5.5 mm (0.22 in.), or from about 5.2 mm (0.2 in.) to about 5.4 mm (0.21 in.). In certain constructions, the metal sheet used for the bullet persistent panel 180 may have variability in its thickness. Pursuant to these situations, the recited numbers represent an average width of the bullet persistent panel 180.

In certain embodiments of the invention the bullet persistent panel is finished to remove all burrs and ensured that any sharp edges are broken to allow the bullet persistent panel to be safe to touch. In certain embodiments of the invention, the surfaces of the bullet persistent panel may be sand blasted to remove mill, scale, and/or grease/oil residue on such surface. In still other embodiments of the invention, a primer may be applied to the surfaces of the bullet persistent panel. In yet other embodiments of the invention, in the event the plate of the bullet persistent panel develops excessive form after cutting, the bullet persistent panel may be flattened prior to further processing and use.

In an embodiment of the invention, a particle board core may encompass the surface of the bullet persistent panel. In other embodiments of the invention, the particle board core is bonded to the bullet persistent panel.

As provided above, the aspect of the invention that provides a method of manufacturing an anti-ballistic door may include the steps of providing a bullet persistent panel; substantially covering both sides of the bullet persistent panel with a foam layer; including a leading stile and a hanging stile, each having a laminated stile and a stile halve defining a key joint assembly for securing the bullet persistent panel; additionally including a top rail and a bottom rail, each having a key along shaft and key walls defining the key joint assembly for securing the bullet persistent panel; securing the top rail and the bottom rail to the leading stile and the hanging stile by inserting key inserts of each of the top rail and the bottom rail into the key joint assembly of the leading stile and the hanging stile; and finishing the anti-ballistic door with a panel. In certain embodiments of the invention, the anti-ballistic door manufactured according to such a method of manufacturing an anti-ballistic panel has at least a UL 752-Level 6 protection, or, more preferably, a UL 752-Level 8 protection.

The method of manufacturing the anti-ballistic door additionally may comprise providing a foam layer that is adhesively bonded to the bullet persistent panel. Optionally, the method of manufacturing an anti-ballistic door may include the step of inserting an anti-ballistic glass in an aperture of the anti-ballistic door to define a lite.

In certain embodiments of the invention, the anti-ballistic door manufactured according to this method of manufacture may comprise a laminated stile comprising a backing and a hardwood edge. Further pursuant to this embodiment of the invention, the laminated stile may additionally comprise an intumescent strip between the backing and the hardwood edge to provide a fire rated ant-ballistic door.

In this method of manufacturing an anti-ballistic door, the key along shaft may additionally comprise a clearance layer that accommodates at least one of an adhesive and variations in a shape of the bullet persistent panel.

Many modifications and other embodiments of the invention set forth herein will come to mind to one skilled in the art to which this invention pertains having the benefit of the teachings presented in the descriptions herein. It will be appreciated by those skilled in the art that changes could be made to the embodiments described herein without departing from the broad inventive concept thereof. Therefore, it is understood that this invention is not limited to the particular embodiments disclosed, but it is intended to cover modifications within the spirit and scope of the present invention as defined by the included claims.

That which is claimed:

1. An anti-ballistic door comprising a keyed joint assembly substantially defining an inner perimeter of the door;

wherein the keyed joint assembly comprises a leading stile, the leading stile comprising a laminated stile and a leading stile halve, the laminated stile and the leading stile halve defining the keyed joint assembly along the leading stile; and a bullet resistant panel secured internal to the door using the keyed joint assembly, wherein the anti-ballistic door having at least a UL 752-Level 6 protection.

2. The anti-ballistic door of claim 1, additionally comprising a foam layer and a diametrically opposed foam layer substantially covering both sides of the bullet resistant panel.

3. The anti-ballistic door of claim 2, wherein the foam layer and the diametrically opposed foam layer are adhesively bonded to the bullet resistant panel.

4. The anti-ballistic door of claim 1, additionally comprising a lite.

5. The anti-ballistic door of claim 4, wherein the anti-ballistic door additionally comprising an aperture where an anti-ballistic glass is inserted to define the lite.

6. The anti-ballistic door of claim 1, wherein the laminated stile comprising a backing and a hardwood edge.

7. The anti-ballistic door of claim 6, wherein the laminated stile additionally comprising an intumescent strip between the backing and the hardwood edge.

8. The anti-ballistic door of claim 6, wherein the backing comprising a structural composite lumber backing.

9. The anti-ballistic door of claim 1, wherein the bullet resistant panel inserted in the key along shaft additionally comprising a clearance layer to accommodate at least one of an adhesive and a variation in a shape of the bullet resistant panel.

10. The anti-ballistic door of claim 1, additionally comprising a panel having a crossband veneer layer.

11. The anti-ballistic door of claim 1, wherein the anti-ballistic door having a UL 752-Level 8 protection.

12. An anti-ballistic panel comprising:

a keyed joint assembly substantially defining an inner perimeter of the panel;

wherein the keyed joint assembly comprises a leading stile, the leading stile comprising a laminated stile and a leading stile halve, the laminated stile and the leading stile halve defining the keyed joint assembly along the leading stile; and a bullet resistant panel secured internal to the panel using the keyed joint assembly, wherein the anti-ballistic panel having at least UL 752-Level 6 protection.

13. The anti-ballistic panel of claim 12, additionally comprising a foam layer and a diametrically opposed foam layer substantially covering both sides of the bullet resistant panel.

14. The anti-ballistic panel of claim 12, wherein the keyed joint assembly comprising a key along shaft and key walls, and the bullet resistant panel inserted in the key along shaft additionally comprising a clearance layer to accommodate at least one of an adhesive and a variation in a shape of the bullet resistant panel.

15. The anti-ballistic panel of claim 12, wherein the anti-ballistic panel having a UL 752-Level 8 protection.

16. A method of manufacturing an anti-ballistic door comprising:

providing a bullet resistant panel;

substantially covering both sides of the bullet resistant panel with a foam layer;

including a leading stile and a hanging stile, each having a laminated stile and a stile halve defining a keyed joint assembly for securing the bullet resistant panel;

additionally including a top rail and a bottom rail, each having a keyed along shaft and key walls defining the key joint assembly for securing the bullet resistant panel;

securing the top rail and the bottom rail to the leading stile and the hanging stile by inserting key inserts of each of the top rail and the bottom rail into the keyed joint assembly of the leading stile and the hanging stile; and finishing the anti-ballistic door with a panel, wherein the anti-ballistic door having at least a UL 752-Level 6 protection.

17. The method of claim 16, additionally comprising inserting an anti-ballistic glass in an aperture of the anti-ballistic door to define a lite.

18. The method of claim 16, wherein the laminated stile comprising a backing, a hardwood edge and an intumescent strip between the backing and the hardwood edge.

19. The method of claim 16, wherein the key along shaft additionally comprising a clearance layer to accommodate at least one of an adhesive and a variation in a shape of the bullet resistant panel.

* * * * *